US009328570B2

(12) United States Patent
Sele

(10) Patent No.: US 9,328,570 B2
(45) Date of Patent: May 3, 2016

(54) GUIDING ASSEMBLY FOR A PIPING SYSTEM

(71) Applicant: Aker Engineering & Technology AS, Lysaker (NO)

(72) Inventor: Arne Barrett Sele, Hosle (NO)

(73) Assignee: Aker Engineering & Technology AS, Lysaker (NO)

( * ) Notice: Subject to any disclaimer, the term of this patent is extended or adjusted under 35 U.S.C. 154(b) by 0 days.

(21) Appl. No.: 14/649,497

(22) PCT Filed: Nov. 25, 2013

(86) PCT No.: PCT/NO2013/050208
§ 371 (c)(1),
(2) Date: Jun. 3, 2015

(87) PCT Pub. No.: WO2014/088420
PCT Pub. Date: Jun. 12, 2014

(65) Prior Publication Data

US 2015/0330159 A1 Nov. 19, 2015

(30) Foreign Application Priority Data

Dec. 7, 2012 (NO) ..... 20121480

(51) Int. Cl.

| | |
|---|---|
| ***E21B 17/01*** | (2006.01) |
| ***E21B 19/00*** | (2006.01) |
| ***E21B 43/01*** | (2006.01) |
| ***B63B 9/06*** | (2006.01) |
| ***E21B 19/24*** | (2006.01) |

(52) U.S. Cl.
CPC ..... *E21B 19/006* (2013.01); *B63B 9/065* (2013.01); *E21B 17/01* (2013.01); *E21B 19/004* (2013.01); *E21B 19/24* (2013.01); *E21B 43/0107* (2013.01)

(58) Field of Classification Search
CPC ..... E21B 17/01; E21B 17/015; E21B 17/017; E21B 19/004; E21B 19/006
USPC ..... 166/367, 352; 405/224.2
See application file for complete search history.

(56) References Cited

U.S. PATENT DOCUMENTS 5,028,171 A * 7/1991 Gray ..... E02B 17/027 405/225
5,551,803 A * 9/1996 Pallini, Jr. ..... E21B 19/09 166/355
5,873,677 A * 2/1999 Davies ..... E21B 17/017 285/216

(Continued)

OTHER PUBLICATIONS

International Search Report International Patent Application Serial No. 20121480; dated May 23, 2013, 2 pages.

*Primary Examiner* — Matthew R Buck
(74) *Attorney, Agent, or Firm* — Nixon Peabody LLP

(57) ABSTRACT

A guiding assembly for a riser piping system (2) in an opening in the bottom (8) of a floating structure, said assembly permitting limited axial and angular displacement of the riser piping system (2) in said opening. The assembly comprises a prismatic anchor (1) surrounding a portion of the riser piping system (2) and being connected thereto, an outer prismatic guide tube (4) receiving the prismatic anchor (1), the outer prismatic guide tube (4) having inner surfaces that are parallel to and equally spaced from outer surfaces on the prismatic anchor (1), and rollers (3) arranged in at least two different levels and confined in spaces (2) formed between said inner and outer surfaces, the rollers (3) permitting relative axial movement between the prismatic anchor (1) and the outer prismatic tube (4).

20 Claims, 3 Drawing Sheets

(56) References Cited

U.S. PATENT DOCUMENTS 6,672,804 B1 * 1/2004 Hallot ..... E21B 17/01 114/264
6,712,560 B1 * 3/2004 Cottrell ..... B63B 21/50 114/264
6,746,182 B2 * 6/2004 Munk ..... E21B 19/004 166/350
7,013,824 B2 * 3/2006 Otten ..... B63B 21/502 114/264
7,217,067 B2 * 5/2007 Mao ..... E21B 19/004 405/224.2
7,537,416 B2 * 5/2009 Wetch ..... B63B 35/4413 166/350
2004/0253059 A1 12/2004 Horton, III
2007/0048094 A1 3/2007 Mao et al.
2007/0056741 A1 3/2007 Finn et al.

* cited by examiner

GUIDING ASSEMBLY FOR A PIPING SYSTEM

CROSS-REFERENCE TO RELATED APPLICATIONS

This application is a U.S. national stage of PCT/NO2013/050208, filed on Nov. 25, 2013 which claims priority to Norwegian Patent Application No. 20121480, filed on Dec. 7, 2012, the contents of which are each incorporated herein by reference in its entirety.

FIELD OF THE INVENTION

The present invention relates to a guiding assembly for a piping system for connection to a well producing oil or natural gas, exporting these products or injecting fluids to improve the pressure of the oil or gas being produced. The piping system connects the well at sea bottom to a floating structure in the sea.

BACKGROUND OF THE INVENTION

Piping systems connecting floating structures to the sea bottom may be designed with a flexible catenary shape or with a near vertical configuration. Such near vertical piping systems require that a constant tensile force is maintained when the floating structure is displaced due to wind, waves and current or by warping. The varying length of the piping system due to such lateral motion must be accommodated by means of maintaining the tension as the top of the piping system moves horizontally. This may be accommodated by hydraulic equipment, by buoyancy or by other means.

At the bottom of the floating structure, the piping system requires a guiding structure which can accommodate sliding of the piping system. The piping system may also need a means of accommodating angular displacement at the bottom of the floating structure.

Current technology consists of combining rigid or flexible guide tubes with sliding metal bearings or rubber bearings which may be reinforced with metal lamella.

The current technology is illustrated by U.S. Pat. Nos. 4,185,694, 5,683,205, 6,884,003, 7,067,201, and 7,217,067.

OBJECT OF THE INVENTION

The object of the present invention is to guide the piping system with lateral support with respect to the floating structure at its bottom such that the piping is free to move in a near vertical direction and that the lateral motion of the floating structure is accommodated.

SUMMARY OF THE INVENTION

The object of the present invention is obtained by a prismatic guide tube supporting a conforming prismatic anchor for a piping system as defined in claim 1. Advantageous embodiments of the prismatic guide tube supporting rollers bearing on a conforming anchor structure for a piping system are defined in the dependent claims.

The present invention uses roller bearings which are not as prone to wear and which can accommodate the uneven surface of a long guide tube, e.g. by making the rollers from pre-compressed flexible tubes, such that the bearings at all times maintain contact with both supported surfaces. By using rollers, their stroke is reduced to half the vertical displacement of the piping system relative to the floating structure.

BRIEF DESCRIPTION OF THE DRAWINGS

Further details of the invention will be described below with reference to the exemplifying embodiments shown schematically in the appended drawings, wherein.

DETAILED DESCRIPTION OF THE DRAWINGS

Figure 1:
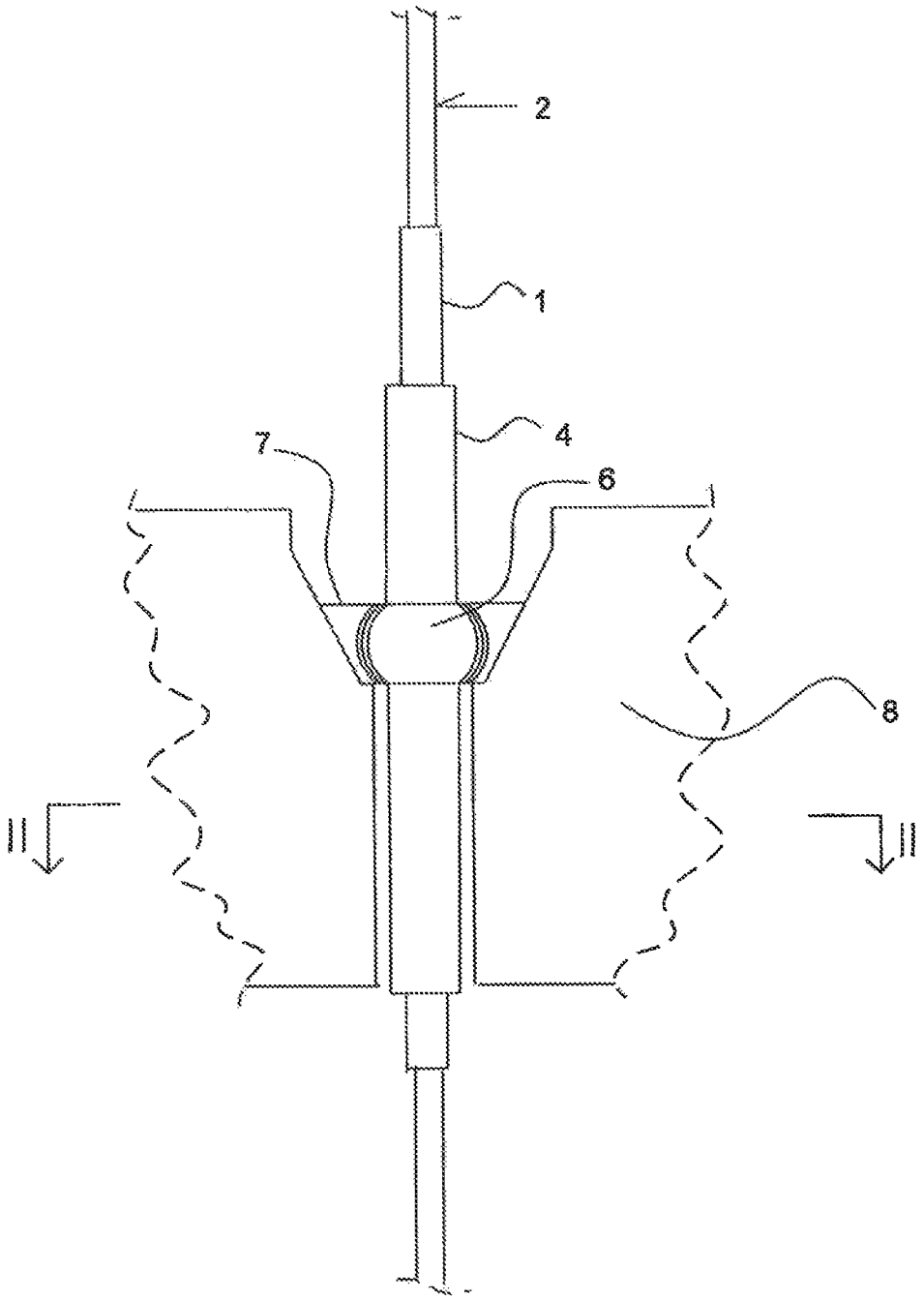
FIG. 1 shows an elevation, partly in section, of a first embodiment of a guiding assembly according to the invention.

FIG. 1 shows an elevation of a guiding assembly for a piping system 2. This is confined in a prismatic anchor 1. The prismatic anchor 1 enters into an outer prismatic tube 4, which may be anchored with a spherical enlargement 6 and has end stops. This spherical enlargement 6 is confined in a conical surrounding component 7, which in turn is supported in a conical porch in the bottom part 8 of the floating structure. The spherical enlargement 6 of the prismatic tube 4 and the spherical surface of the surrounding component 7 act as a bearing. The bearing functions by sliding in metal to metal contact, or by elastic deformation of rubber or other suitable resilient material reinforced with lamella of steel or other suitable material between the spherical surfaces.

Figure 2:
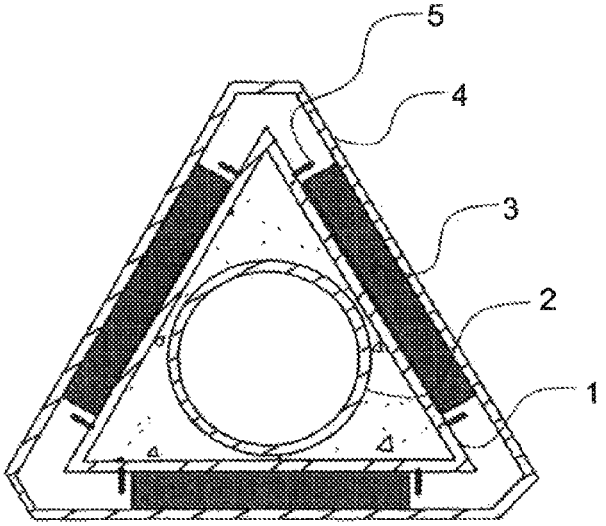
FIG. 2 shows a cross sectional view of the guiding assembly along line II-II in FIG. 1.

FIG. 2 shows a cross section of the guiding assembly having an outer prismatic tube 4 which confines a plurality of flexible rollers 3, which in the figure are shown as three in number at each of two levels. The rollers bear against a conforming prismatic anchor 1, which may be connected to the piping system 2 by filling the cavity with grout or other solidifying material. Alternatively, the connection may be made with a structure of welded ribs. Guides 5 control the alignment of the rollers.

The flexible rollers 3 are of a tubular shape such that they may, if desirable, be pre-compressed in order to accommodate unevenness in the surfaces of the prismatic tube 4 and also of the surface of the prismatic anchor 1. The surface of the rollers 3 may also be covered with a resilient material.

Figure 3A:
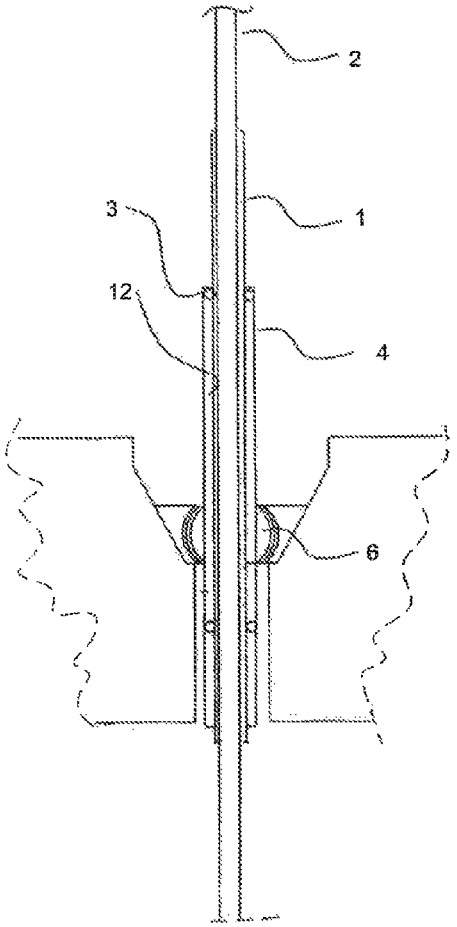
FIG. 3*a* and FIG. 3*b* show a vertical cross sectional view of the guiding assembly in FIG. 1 in two different positions.
Figure 3B:
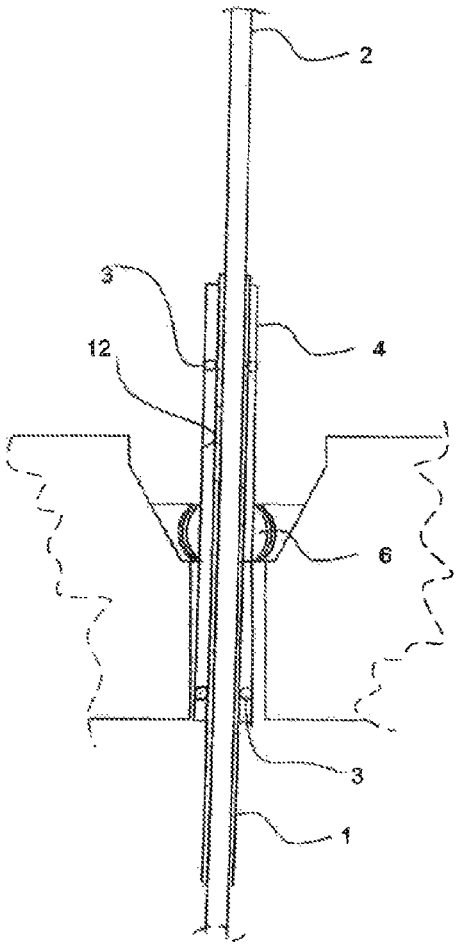

FIG. 3*a* and FIG. 3*b* show a vertical cross sectional view of the guiding assembly with the prismatic anchor 1 in two different positions and the rollers 3 in different positions in the space 12 between the anchor 1 and guide tube 4.

FIG. 3*a* shows the position of the prismatic anchor 1 when the floating structure is positioned immediately above the well and where there is no current or other lateral load. In this position, the rollers 3 are located such that the uppermost rollers 3 are near an upper end stop of the guide tube 4. In this position, the lower end of the prismatic anchor 1 projects a short distance below the lower end of the guide tube 4.

FIG. 3*b* shows the position of the prismatic anchor where the floating structure is at its most extreme excursion. In this position the rollers 3 have moved down such that the lower roller is near an end stop of the guide tube 4. The movement of the prismatic anchor 1 is twice that of the rollers 3.

Figure 4:
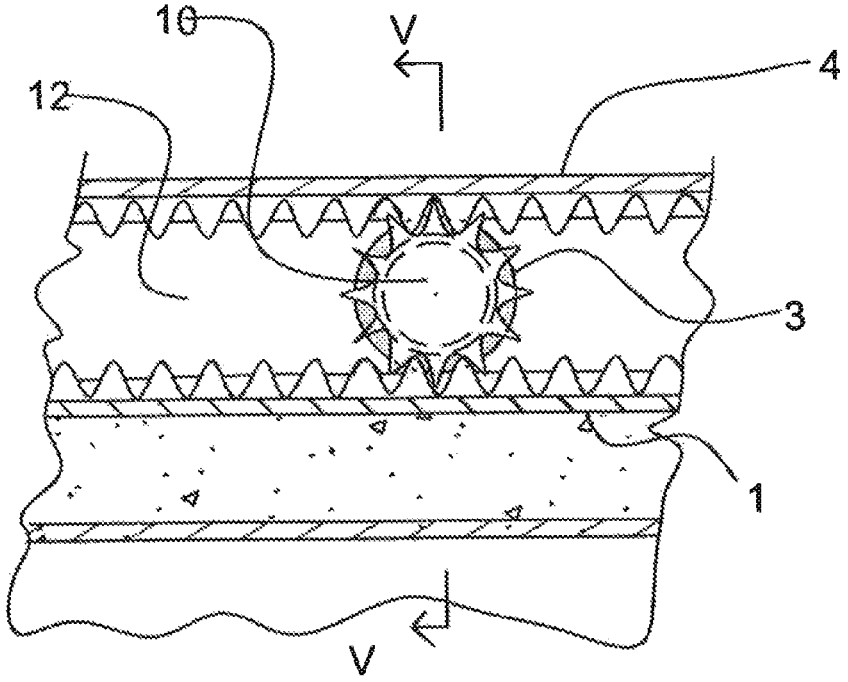
FIG. 4 shows an elevation in section of a second embodiment of a guiding assembly according to the invention, the section being taken along the line IV-IV in FIG. 5.

FIG. 4 shows how the simple guides 5 shown in FIG. 2 may be replaced by a cylindrical, preferably solid shaft 9 inside the flexible tubular roller 3. The shaft 9 is attached to a toothed wheel 10 at either end in engagement with racks 11 to provide proper alignment and improved guiding of the roller 3. The racks 11 are lo fixed to the prismatic anchor 1 and the prismatic tube 4 at either end of the flexible tubular roller 3. FIG. 4 shows racks 11 on both the inside of the guide tube 4 and the outside of the anchor 1. A simpler arrangement would be to have racks on one of the parts only, preferably the anchor 1. However, this would require a closer fit between the shaft 9 and tubular roller 3 in order to eliminate the risk of the toothed wheel slipping out of engagement with the rack. Preferably, the pitch diameter of the toothed wheel should equal the diameter of the tubular roller 3.

Figure 5:
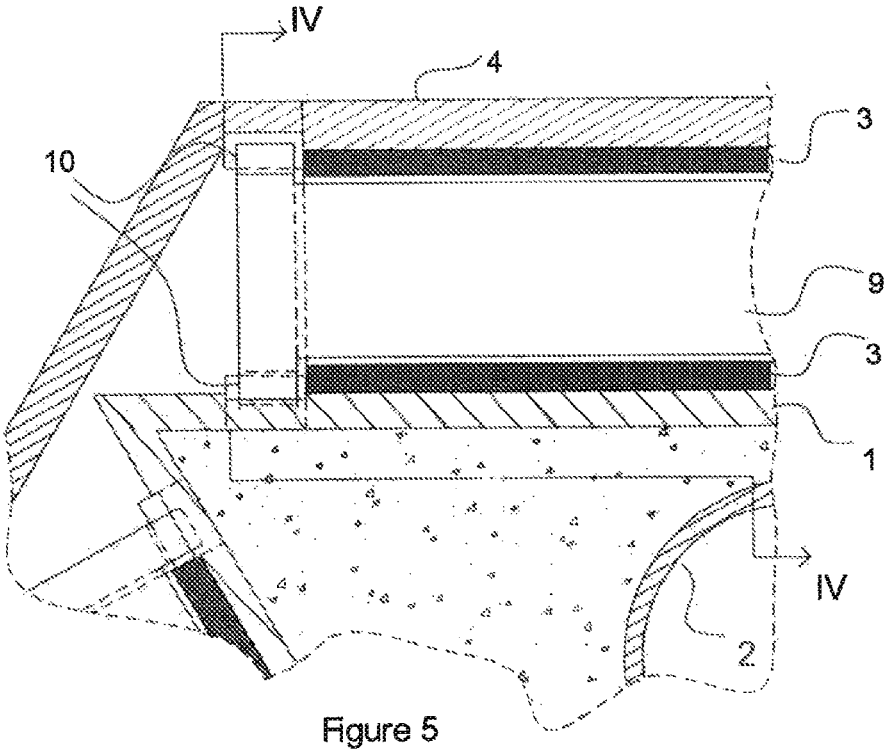
FIG. 5 shows a cross section along the line V-V through the arrangement shown in FIG. 4.

FIG. 5 shows a cross section along the line V-V through the arrangement shown in FIG. 4 at a somewhat larger scale. In addition to the parts mentioned above, the piping system 2 is indicated.

It will be understood that the invention is not limited to exemplifying embodiments described above, but may be varied and modified by the skilled person within the scope of the following claims.

The invention claimed is:

1. A guiding assembly for a riser piping system (2) in an opening in the bottom (8) of a floating structure, said assembly permitting limited axial and angular displacement of the riser piping system (2) in said opening, said assembly comprising:

a prismatic anchor (1) surrounding a portion of the riser piping system (2) and being connected thereto, an outer prismatic guide tube (4) receiving the prismatic anchor (1), the outer prismatic guide tube (4) having inner surfaces that are parallel to and equally spaced from outer surfaces on the prismatic anchor (1), the anchor and guide tube being at least substantially triangular in cross-section, and rollers (3) arranged in at least two different levels and confined in spaces (2) formed between said inner and outer surfaces, the rollers (3) permitting relative axial movement between the prismatic anchor (1) and the outer prismatic tube (4) without being fixed to any of said inner and outer surfaces.

2. A guiding assembly according to claim 1, wherein said confined rollers (3) are in the form of flexible tubes.

3. A guiding assembly according to claim 1, wherein said guide tube (4) is supported in the bottom (8) of the floating structure by a bearing comprising a surrounding component (7) with a spherical surface, and a section of the guide tube (4) with a spherical enlargement (6) supported in a similar confining surface, permitting limited free rotation of the guide tube.

4. A guiding assembly according to claim 1, wherein said guide tube (4) is supported in the bottom of the floating structure by flexible supports accommodating deformation in the axial direction of the guide tube (4).

5. A guiding assembly according to claim 1, wherein the guide tube (4) is supported in the opening in the bottom (8) of the floating structure.

6. A guiding assembly according to claim 4, wherein said anchor (1) for the piping system (2) is connected to the piping system (2) by a bearing which permits limited free rotation.

7. A guiding assembly according to claim 1, wherein said rollers (3) are covered with resilient material.

8. A guiding assembly according to claim 1, wherein the space between the anchor (1) and the piping system (2) is filled with grout or other solidifying material for stiffening the combined structure.

9. A guiding assembly according to claim 1, wherein the prismatic anchor (1) and guide tube (4) have substantially triangular cross sections.

10. A guiding assembly according to claim 5, wherein said anchor (1) for the piping system (2) is connected to the piping system (2) by a bearing which permits limited free rotation.

11. A guiding assembly according to claim 2, wherein said guide tube (4) is supported in the bottom (8) of the floating structure by a bearing comprising a surrounding component (7) with a spherical surface, and a section of the guide tube (4) with a spherical enlargement (6) supported in a similar confining surface, permitting limited free rotation of the guide tube.

12. A guiding assembly according to claim 2, wherein said guide tube (4) is supported in the bottom of the floating structure by flexible supports accommodating deformation in the axial direction of the guide tube (4).

13. A guiding assembly according to claim 2, wherein the guide tube (4) is supported in the opening in the bottom (8) of the floating structure.

14. A guiding assembly according to claim 2, wherein said rollers (3) are covered with resilient material.

15. A guiding assembly according to claim 3, wherein said rollers (3) are covered with resilient material.

16. A guiding assembly according to claim 4, wherein said rollers (3) are covered with resilient material.

17. A guiding assembly according to claim 5, wherein said rollers (3) are covered with resilient material.

18. A guiding assembly according to claim 6, wherein said rollers (3) are covered with resilient material.

19. A guiding assembly according to claim 2, wherein the prismatic anchor (1) and guide tube (4) have substantially triangular cross sections.

20. A guiding assembly for a riser piping system (2)in an opening in the bottom (8) of a floating structure, said assembly permitting limited axial and angular displacement of the riser piping system (2) in said opening, said assembly comprising:

a prismatic anchor (1) surrounding a portion of the riser piping system (2) and being connected thereto, an outer prismatic guide tube (4) receiving the prismatic anchor (1), the outer prismatic guide tube (4) having inner surfaces that are parallel to and equally spaced from outer surfaces on the prismatic anchor (1), and rollers (3) arranged in at least two different levels and confined in spaces (2) formed between said inner and outer surfaces, the rollers (3) permitting relative axial movement between the prismatic anchor (1) and the outer prismatic tube (4), wherein said confined rollers (3) are in the form of flexible tubes, wherein the fexible tubes of the rollers are each rotatably arranged on a shaft (9), the shaft being provided with a toothed wheel (10) at either end engaging in at least one rack (11) extending axially along at least one of said inner and outer surfaces for maintaining the alignment of the roller (3) when moving between said surfaces.

* * * * *